US010375466B2

(12) United States Patent
Sheffield et al.

(10) Patent No.: US 10,375,466 B2
(45) Date of Patent: Aug. 6, 2019

(54) REDISTRIBUTING GAIN TO REDUCE NEAR FIELD NOISE IN HEAD-WORN AUDIO SYSTEMS

(71) Applicant: HARMAN INTERNATIONAL INDUSTRIES, INCORPORATED, Stamford, CT (US)

(72) Inventors: Branden Sheffield, Saratoga Springs, UT (US); James M. Kirsch, Salt Lake City, UT (US)

(73) Assignee: HARMAN INTERNATIONAL INDUSTRIES, INC., Stamford, CT (US)

( * ) Notice: Subject to any disclaimer, the term of this patent is extended or adjusted under 35 U.S.C. 154(b) by 0 days.

(21) Appl. No.: 15/448,506

(22) Filed: Mar. 2, 2017

(65) Prior Publication Data

US 2017/0257697 A1 Sep. 7, 2017

Related U.S. Application Data

(60) Provisional application No. 62/303,194, filed on Mar. 3, 2016.

(51) Int. Cl.

| | |
|---|---|
| ***H04R 1/10*** | (2006.01) |
| ***H04S 7/00*** | (2006.01) |
| *H04R 25/00* | (2006.01) |

(52) U.S. Cl.

CPC ..... *H04R 1/1083* (2013.01); *H04R 1/1041* (2013.01); *H04S 7/30* (2013.01); *H04S 7/304* (2013.01); *H04R 1/1008* (2013.01); *H04R 25/552* (2013.01); *H04R 2430/20* (2013.01); *H04S 2400/13* (2013.01); *H04S 2420/01* (2013.01)

(58) Field of Classification Search

CPC ..... H04R 1/1083; H04R 1/1041; H04S 1/005; H04S 7/304; H04S 2420/01

USPC ..... 381/26, 56–58, 317, 71.1, 71.2, 71.6, 381/71.8, 13, 71.11, 73.1, 74, 94.1–94.3, 381/95, 122, 370, 375

See application file for complete search history.

(56) References Cited

U.S. PATENT DOCUMENTS

| | | | | |
|---|---|---|---|---|
| 5,371,799 | A * | 12/1994 | Lowe | H04S 1/005 381/17 |
| 2010/0061568 | A1* | 3/2010 | Rasmussen | H04R 3/005 381/94.1 |
| 2012/0020485 | A1* | 1/2012 | Visser | H04R 3/005 381/57 |

* cited by examiner

*Primary Examiner* — Norman Yu
(74) *Attorney, Agent, or Firm* — Artegis Law Group, LLP

(57) ABSTRACT

In one embodiment, a gain redistribution application restructures gains associated with multiple microphones included in a head-worn audio system to minimize near field noise. In response to a sound generated by a sound source, the microphones generate input signals. The gain redistribution application performs mixing operations on the input signals to generate an output signal that mitigates near field noise associated with the same side of the head as the sound source. Subsequently, the gain redistribution application transmits the output signal to a speaker that targets the same side of the head as the sound source. Advantageously, by reducing the gain associated with an input signal received via a microphone located on the same side of the head as the sound source, the gain redistribution application reduces near field noise transmitted to the user during operation in a more comprehensive fashion relative to conventional designs.

21 Claims, 4 Drawing Sheets

REDISTRIBUTING GAIN TO REDUCE NEAR FIELD NOISE IN HEAD-WORN AUDIO SYSTEMS

CROSS-REFERENCE TO RELATED APPLICATIONS

This application claims benefit of the U.S. Provisional Patent Application having Ser. No. 62/303,194 and filed on Mar. 3, 2016. The subject matter of this related application is hereby incorporated herein by reference.

BACKGROUND

Field of the Various Embodiments

The various embodiments relate generally to audio systems and, more specifically, to redistributing gain to reduce near field noise in head-worn audio systems.

Description of the Related Art

Many head-worn audio systems acquire sound from surrounding environments via integrated microphones and then deliver associated sound to the users of such systems via integrated speakers. Well-known examples of such head-worn audio systems include wired and wireless hear-through headphones, binaural (i.e., targeting both ears of a user) hearing aids, and the like. With these types of head-worn audio systems, undesired sound may be received by one of the microphones from a source that is located relatively close (e.g., two wavelengths) to the microphone and then transmitted to the user via the integrated speaker associated with the microphone. Such undesired sound is referred to as "near field noise," and this type of noise can substantially degrade the quality of the listening experience. Examples of near field noise include acoustic feedback, noise associated with the microphone itself, wind noise, and chewing noise, to name a few.

In an attempt to improve the quality of the listening experience, some head-worn audio systems include fitted inserts that attempt to position the speakers more tightly within the ears of a user. For example, some earphones may include ear buds that are designed to fit inside the pinna regions of the user's ears, and some hearing aids are custom-fit for each ear of the user. When fitted inserts are worn by a user, each integrated speaker creates a sound chamber relative to one of the ears of the user that reduces the amount of sound that is leaked outside the ear during operation as well as the amount near field noise attributable to that leaked sound.

One limitation of the conventional designs noted above is that those designs still suffer from the effects of near field noise. For example, as indicated above, fitted inserts reduce, but do not necessarily eliminate, near field noise because the sound that travels through the fitted inserts within the ears as well as leaked sound can cause acoustic feedback. Many of the other conventional designs discussed above do not include fitted inserts, but, instead, include open-back earphones. These types of earphones provide acoustic transparency that enable the user to hear sounds from the outside environment during operation, but allow a relatively large amount of sound to be leaked outside the ears during operation. Consequently, users oftentimes experience degraded listening experiences attributable to near field noise with such designs.

As the foregoing illustrates, more effective techniques for delivering sound via head-worn audio systems would be useful.

SUMMARY

One embodiment sets forth a method for delivering sound via a head-worn audio system. The method includes determining that a source of a sound is present on a first side of a head based on a first input signal generated by a first microphone that is located on the first side of the head and a second input signal generated by a second microphone that is located on a second side of the head; performing one or more mixing operations on the first input signal and the second input signal to generate a first output signal that mitigates near field noise included in the first input signal; and transmitting the first output signal to a first speaker that is arranged to deliver sound to a first ear that is located on the first side of the head.

Further embodiments provide, among other things, a head-worn audio system and a computer-readable medium configured to implement the method set forth above.

At least one advantage of the disclosed techniques is that the head-worn audio system provides an optimized listening experience. More specifically, by performing mixing operations that restructure the gain between microphones and speakers, the head-worn audio system reduces near field noise transmitted to the user during operation in a more comprehensive fashion relative to conventional designs.

BRIEF DESCRIPTION OF THE DRAWINGS

So that the manner in which the above recited features can be understood in detail, a more particular description of the various embodiments, briefly summarized above, may be had by reference to certain embodiments, some of which are illustrated in the appended drawings. It is to be noted, however, that the appended drawings illustrate only typical embodiments and are therefore not to be considered limiting of scope, for the contemplated embodiments may admit to other equally effective embodiments.

DETAILED DESCRIPTION

In the following description, numerous specific details are set forth to provide a more thorough understanding of the various embodiments. However, it will be apparent to one of skill in the art that various embodiments may be practiced without one or more of these specific details.

Audio System

Figure 1:
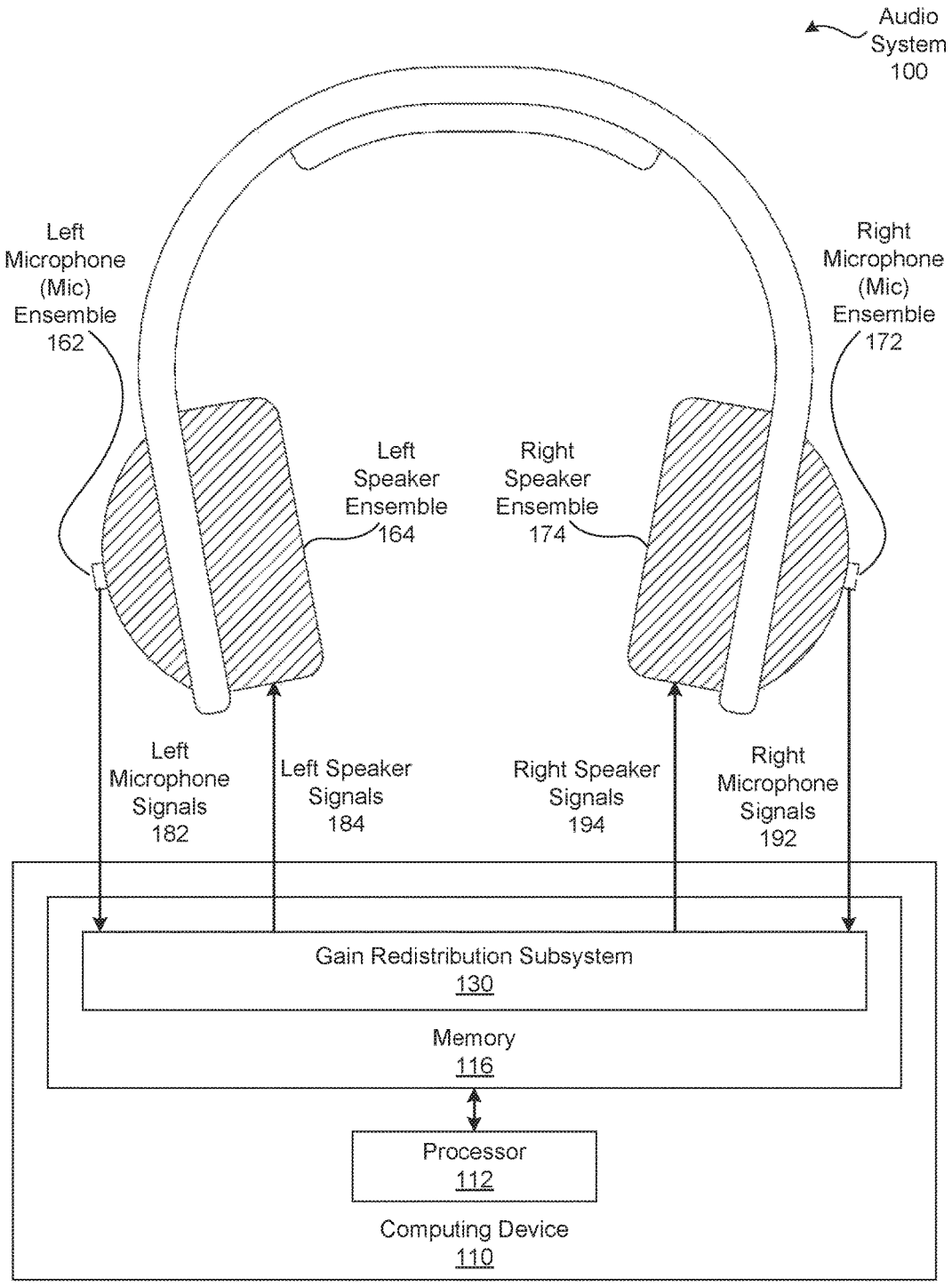
FIG. 1 illustrates an audio system configured to implement one or more aspects of the various embodiments.

FIG. 1 illustrates an audio system 100 configured to implement one or more aspects of the various embodiments. As shown, the audio system 100 includes, without limitation, a left microphone (mic) ensemble 162, a left speaker ensemble 164, a right microphone ensemble 172, a right speaker ensemble 174, and a computing device 110. The left microphone ensemble 162 and the left speaker ensemble 164 are designed to be arranged in close proximity to a left ear of a user. By contrast, the right microphone ensemble 172 and the right speaker ensemble 174 are designed to be arranged in close proximity to a right ear of the user. For explanatory purposes, multiple instances of like objects are denoted with reference numbers identifying the object and parenthetical numbers identifying the instance where needed.

The left microphone ensemble 162 includes, without limitation, one or more microphones (not shown). In operation, the left microphone ensemble 162 acquires sound from the environment surrounding the user, generates one or more left microphone signals 182 from the sound, and transmits the left microphone signals 182 to the computing device 110 for processing. The left speaker ensemble 164 includes, without limitation, one or more speakers (not shown). In operation, the left speaker ensemble 164 receives left speaker signals 184 from the computing device 110 and generates sound based on the left speaker signals 184.

The right microphone ensemble 172 includes, without limitation, one or more microphones. In operation, the right microphone ensemble 172 acquires sound from the environment surrounding the user, generates one or more right microphone signals 192 from the sound, and transmits the right microphone signals 192 to the computing device 110 for processing. The right speaker ensemble 174 includes, without limitation, one or more speakers. In operation, the right speaker ensemble 174 receives right speaker signals 194 from the computing device 110 and generates sound based on the right speaker signals 194.

In general, the audio system 100 may comprise any type of head-worn audio system. As referred to herein, a "head-worn audio system" is any binaural (i.e. targeting both ears of the user) listening audio system that is intended to be worn on a head of a user. The head of the user is also referred to herein as "the head." The audio system 100 may include any number of components, and the components may be connected in any technically feasible fashion. For instance, in various embodiments, the audio system 100 could comprise the over-the-ear headphones shown in FIG. 1, and the computing device 110 could be integrated into the over-the-ear headphones. In alternate embodiments, the audio system 100 may be circumaural headphones, on-ear headphones, in-ear headphones, binaural hearing aids, a mobile communications device, etc. Further, the audio system 100 may include any type of additional audio functionality (e.g., noise-isolation functionality, noise-cancellation functionality, etc.)

For example, each of the left microphone ensemble 162 and the right microphone ensemble 172 could include two microphones that are designed to face away from the respective ear of the user. The computing system 110 could align and combine the sound acquired from the microphones to increase sound arriving towards the front of the head while reducing sound arriving towards the sides and rear of the head. In another example, each of the left speaker ensemble 164 and the right speaker ensemble 174 could include three speakers. The computing system 110 could configure one left speaker and one right speaker to generate low frequency sound, another left speaker and another right speaker to generate mid frequency sound, and the final left speaker and the final right speaker to generate high frequency sound.

As shown, the computing device 110 includes, without limitation, a processor 112 and a memory 116. The processor 112 may be any instruction execution system, apparatus, or device capable of executing instructions. For example, the processor 112 could comprise a central processing unit (CPU), a Digital Signal Processor (DSP), a graphics processing unit (GPU), a controller, a microcontroller, a state machine, or any combination thereof. The memory 116 stores content, such as software applications and data, for use by the processor 112. The memory 116 may be one or more of a readily available memory, such as random access memory (RAM), read only memory (ROM), floppy disk, hard disk, or any other form of digital storage, local or remote. In some embodiments, a storage (not shown) may supplement or replace the memory 116. The storage may include any number and type of external memories that are accessible to the processor 112. For example, and without limitation, the storage may include a Secure Digital Card, an external Flash memory, a portable compact disc read-only memory (CD-ROM), an optical storage device, a magnetic storage device, or any suitable combination of the foregoing.

The computing device 110 may be incorporated into the audio system 100 in any technically feasible fashion and as any number of discrete or integrated units. For example, each of the processing unit 112 and the memory 114 may be embedded in or mounted on an ear bud associated with either ear or a physical connection between two ear buds. In various embodiments, the computing device 110 may be implemented as a stand-alone chip or as part of a more comprehensive solution that is implemented as an application-specific integrated circuit (ASIC), a system-on-a-chip (SoC), and so forth. In alternate embodiments, any portion, including all, of the computing device 110 may be external to the portions of the audio system 100 that are worn by the user. For example and without limitation, the computing device 110 may be a laptop, a tablet, a smartphone, or the like. In various embodiments, the functionality associated with the computing device 110 may be implemented (e.g., stored, executed, etc.) in a cloud instead of the computing device 110 in any technically feasible fashion.

As is well known, with conventional head-worn audio systems, undesired sound may be received by one of the microphones from a source that is located relatively close (e.g., two wavelengths) to the microphone and then transmitted to the user via an integrated speaker associated with the microphone. Such undesired sound is referred to herein as "near field noise," and this type of noise can substantially degrade the quality of the listening experience. Examples of near field noise include acoustic feedback, noise associated with the microphone itself, wind noise, and chewing noise, to name a few.

In an attempt to improve the quality of the listening experience, some head-worn audio systems include fitted inserts that attempt to position the speakers more tightly within the ears of a user. For example, some earphones may include ear buds that are designed to fit inside the pinna regions of the user's ears, and some hearing aids are custom-fit for each ear of the user. When fitted inserts are worn by a user, each integrated speaker creates a sound chamber relative to one of the ears of the user that reduces the amount of sound that is leaked outside the ear during operation as well as the amount near field noise attributable to that leaked sound.

One limitation of the conventional designs noted above is that those designs still suffer from the effects of near field noise. For example, as indicated above, fitted inserts reduce, but do not necessarily eliminate, near field noise because the sound that travels through the fitted inserts within the ears as well as leaked sound can cause acoustic feedback. Many of the other conventional designs discussed above do not include fitted inserts, but, instead, include open-back earphones. These types of earphones provide acoustic transparency that enable the user to hear sounds from the outside environment during operation, but allow a relatively large amount of sound to be leaked outside the ears during operation. Consequently, users oftentimes experience degraded listening experiences attributable to near field noise with such designs.

Redistributing Gain to Improve the Listening Experience

To reduce near field noise transmitted to the user during operation in a more comprehensive fashion relative to conventional designs, the audio system 100 includes a gain redistribution subsystem 130. The gain redistribution subsystem 130 is also referred to herein as the gain redistribution application. Notably, the gain redistribution subsystem 130 is effective for a wide range of audio systems 100. For instance, in some embodiments, the gain redistribution subsystem 130 improves the quality of the sound delivered via an audio system that include fitted inserts. In other embodiments, the gain redistribution subsystem 130 improves the quality of the sound delivered via an audio system that includes open-back earphones. As shown, the gain redistribution subsystem 130 resides in the memory 116, and the processor 112 executes the gain redistribution subsystem 130. In alternate embodiments, the gain redistribution subsystem 130 may be implemented (e.g., stored, executed, etc.) in any technically feasible fashion. For example, the gain redistribution subsystem 130 could be stored in memory included in a cloud and executed via a processor included in the cloud.

In general, the gain redistribution subsystem 130 performs mixing operations that restructure a near field gain while maintaining an overall far field gain to generate an ipsilateral output signal. As referred to herein, "near field gain" refers to a gain that is associated with sound received by a microphone from sources that are located relatively close (e.g., two wavelengths) to the microphone, while "far field gain" refers to a gain associated with the remaining sound received by the microphone.

As referred to herein, when the sound source is on a left side of a head, "ipsilateral" refers to a left side of the head, and "contralateral" refers to a right side of the head. Further, the left microphone signals 182 are also referred to as "ipsliateral input signals," the left speaker signals 184 are also referred to as "ipsilateral output signals," the right microphone signals 192 are also referred to as "contralateral input signals," and the right speaker signals 194 are also referred to as "contralateral output signals." Finally, the left ear of the head is referred to as the "ispilateral ear" and the right ear of the head is referred to as the "contralateral ear."

By contrast, when the sound source is on the right side of the head, "ipsilateral" refers to the right side of the head, and "contralateral" refers to the left side of the head. Further, the right microphone signals 192 are also referred to as the "ipsliateral input signals," the right speaker signals 194 are also referred to as the "ipsilateral output signals," the left microphone signals 182 are also referred to as the "contralateral input signals," and the left speaker signals 184 are also referred to as the "contralateral output signals." Finally, the right ear of the head is referred to as the "ispilateral ear" and the left ear of the head is referred to as the "contralateral ear." Notably, because the sound source and the associated position may change over time, the sides of the head to which "ipsilateral" and "contralateral" refer may change over time.

In operation, the gain redistribution subsystem 130 determines an ipsilateral side that indicates whether the sound source is present on the left side of the head or on the right side of the head based on the left microphone signals 182 and the right microphone signals 192. The gain redistribution subsystem 130 then performs mixing operations on the ipsilateral input signals and the contralateral input signals to generate the ipsilateral output signals and the contralateral output signals.

Advantageously, if the gain redistribution subsystem 130 determines that the sound source is located on the left side of the head, then the gain redistribution subsystem 130 transfers a portion of a desired amplification from the left microphone signals 182 to the right microphone signals 192 to generate the left speaker signals 184. If, however, the gain redistribution subsystem 130 determines that the sound source is located on the right side of the head, then the gain redistribution subsystem 130 transfers a portion of a desired amplification from the right microphone signals 192 to the left microphone signals 182 to generate the right speaker signals 194. By reducing the near field gain in this fashion, the gain redistribution subsystem 130 reduces the amount of near field noise that the user receives via the ipsilateral speaker ensemble.

Note that the techniques described herein are illustrative rather than restrictive, and may be altered without departing from the broader spirit and scope of the contemplated embodiments. In particular, embodiments include any applications or audio systems that are configured to perform mixing operations on input signals received from multiple microphones that restructure a gain to decrease near field noise that is transmitted via a speaker. In various embodiments, the gain redistribution subsystem 130 may receive and process the left microphone signals 182 and the right microphone signals 192 in any technically feasible fashion. For instance, in some embodiments, the gain redistribution subsystem 130 buffers the left microphone signals 182 and the right microphone signals 192 over one second intervals as part of determining an angle between a sound source and a front of the head. Similarly, in various embodiments, the gain redistribution subsystem 130 may generate the left speaker signals 184 and the right speaker signals 194 and transmit the left speakers signals 184 and the right speaker signals 194 to, respectively, the left speaker ensemble 164 and the right speaker ensemble 172 in any technically feasible fashion.

Figure 2:
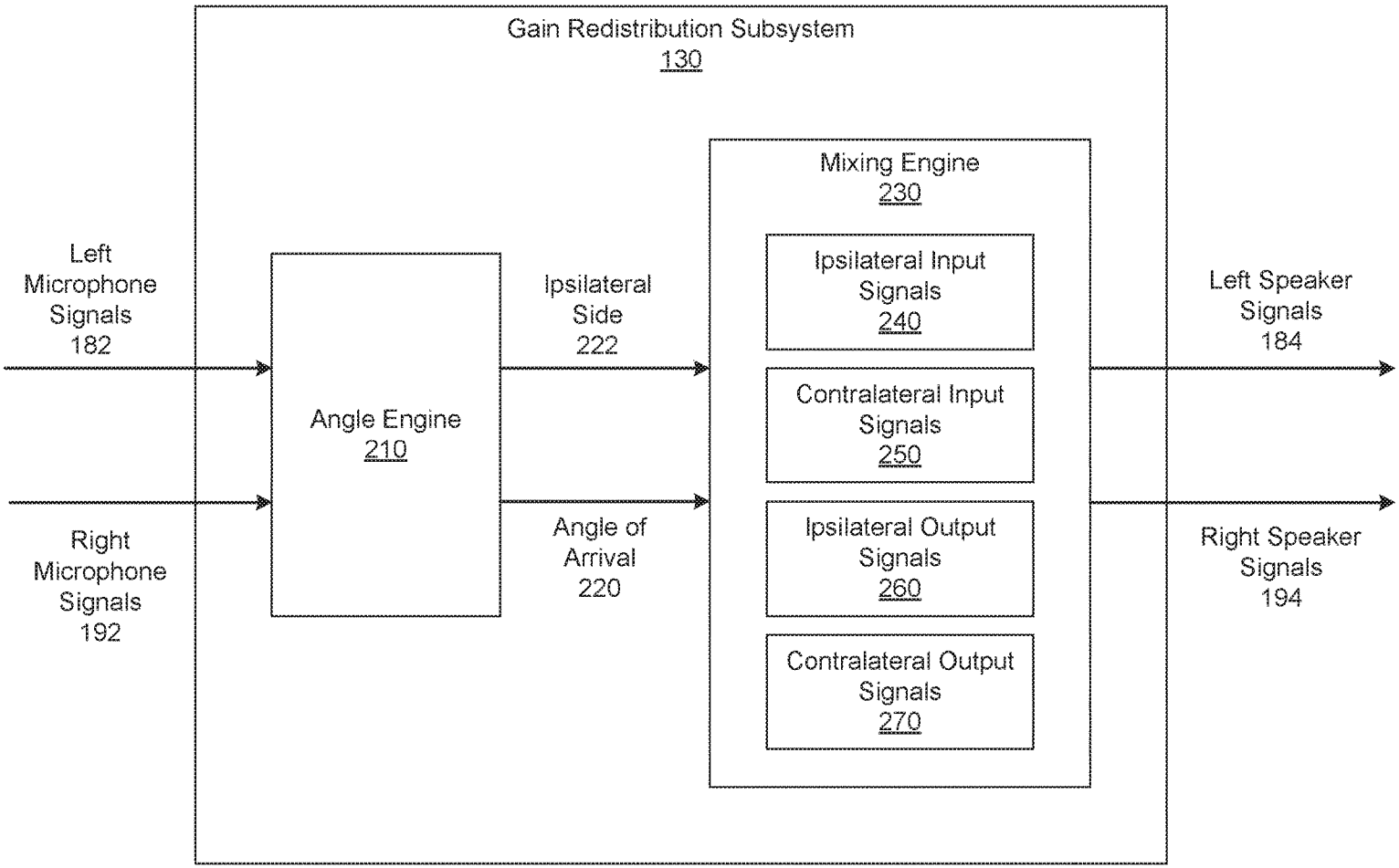
FIG. 2 is a more detailed illustration of the gain redistribution subsystem of FIG. 1, according to various embodiments.

FIG. 2 is a more detailed illustration of the gain redistribution subsystem 130 of FIG. 1, according to various embodiments. As shown, the gain redistribution subsystem 130 includes, without limitation, an angle engine 210 and a mixing engine 230. In general, the gain redistribution subsystem 130 may receive any number of the left microphone signals 182 and any number of the right microphone signals 192 in any technically feasible fashion using any communications protocols as known in the art. Further, the gain redistribution subsystem 130 may operate on segments of the left microphone signals 182 and the right microphone signals 192. For instance, in some embodiments, the gain redistribution subsystem may operate on contiguous time segments of the left microphone signals 182 and the right microphone signals 192, where each time segment represents one second.

As shown, the angle engine 210 receives the left microphone signals 182 and the right microphone signals 192, computes an angle of arrival 220, and sets an ipsilateral side 222 to either "left" or "right." The angle of arrival 220 is an angle between the sound source and a front of the head. The angle engine 210 may express the angle of arrival 220 in any technically feasible fashion that is consistent with the mixing engine 230. For example, in some embodiments, the angle engine 210 could express the angle of arrival 220 in degrees, where 90 degrees indicates that the sound source is directly to the right of the head, 270 degrees indicates the sound source is directly to the left of the head, etc.

As part of computing the angle of arrival 220, the angle engine 210 determines the ipsilateral side 222. If the angle engine 210 determines that the sound source is to the left of the head, then the angle engine 210 sets the ipsilateral side 222 equal to left. By contrast, if the angle engine 210 determines that the sound source is to the right of the head, then the angle engine 210 sets the ipsilateral side 222 equal to right.

In general, the angle engine 210 may compute the angle of arrival 220 in any technically feasible fashion that is consistent with the spatial arrangement of the microphones that generate the left microphone signals 182 and the right microphone signals 192. For instance, in some embodiments, the left microphone ensemble 162 includes at least a left-front microphone that generates the left microphone signal 182(1) and a left-back microphone that generates the left microphone signal 182(2). Similarly, the right microphone ensemble 172 includes at least a right-front microphone that generates the right microphone signal 192(1) and a right-back microphone that generates the right microphone signal 192(2). In some such embodiments, the angle engine 210 may implement a one step process to directly determine the angle of arrival 210 and the ipsilateral side 222 based on any combination of at least three of the left microphone signal 182(1), the left microphone signal 182(2), the right microphone signal 192(1), and the right microphone signal 192(2). Alternatively, the angle engine 210 may implement a three-step process to compute the angle of arrival 220.

Figure 3:
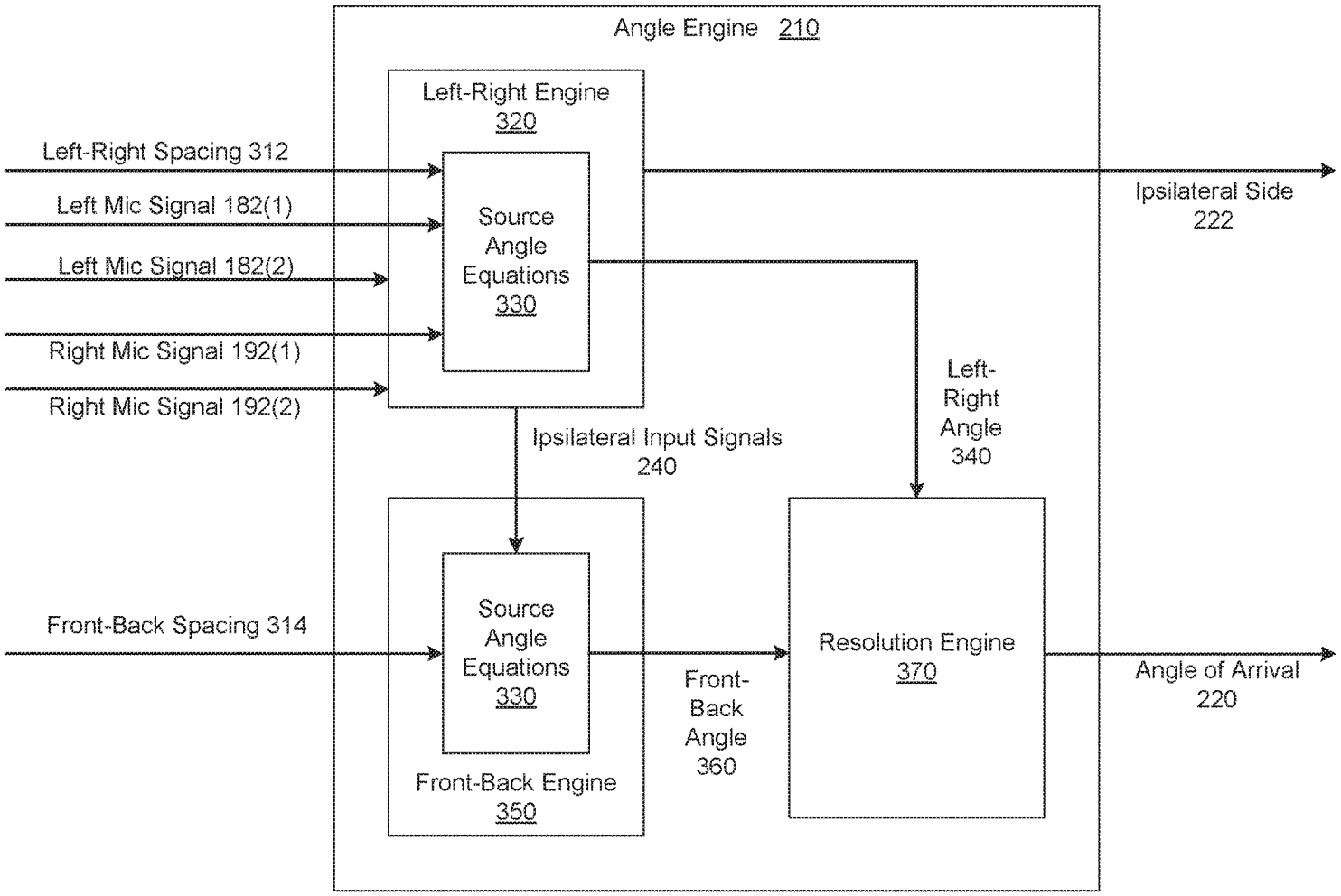
FIG. 3 is a more detailed illustration of the angle engine of FIG. 2, according to various embodiments.

In a first step, the angle engine 210 computes a left-right angle between the sound source and the head based on one of the left microphone signals 182 and one of the right microphone signals 192. The angle engine 210 determines the ipsilateral side 222 and corresponding ipsilateral input signals 240 based on the left-right angle. In a second step, the angle engine 210 computes a front-back angle between the sound source and the head based on the ipsilateral input signal 240(1) and the ipsilateral input signal 240(2), where the ipsilateral input signal 240(1) is located in front of the ipsilateral input signal 240(2). In a final step, the angle engine 210 computes the angle of arrival 220 based on the left-right angle and the front-back angle. The angle engine 210 may implement any number and type of algorithms to compute the left-right angle, the front-back angle, and the angle of arrival 220. FIG. 3 describes one set of algorithms in greater detail.

In other embodiments, each of the left microphone ensemble 162 and the right microphone ensemble 172 includes a single microphone. As persons skilled in the art will recognize, the angle engine 210 is able to determine the left-right angle and the ipsilateral side 222 based on the single left microphone signal 182(1) and the single right microphone signal 192(1). However, the angle engine 210 is not able to determine the front-back angle without additional information that indicates whether the sound source is to the front or the back of the head. In some such embodiments, the angle engine 210 may be configured to set the angle of arrival 220 equal to left-right angle.

After the angle engine 210 computes the angle of arrival 220 and the ipsilateral side 222, the mixing engine 230 performs mapping operations on the inputs based on the ipsilateral side 222. More specifically, if the ipsilateral side 222 is equal to left, then the mixing engine 230 maps the left microphone signals 182 to the ipsilateral input signals 240 and the right microphone signals 192 to contralateral input signals 250. By contrast, if the ipsilateral side 222 is equal to right, then the mixing engine 230 first maps the right microphone signals 192 to the ipsilateral input signals 240 and the left microphone signals 182 to the contralateral input signals 250. The mixing engine 230 may implement the mapping operations in any technically feasible fashion. In various embodiments and as part of computing the angle of arrival 220, the angle engine 210 may, in addition to or instead of the mixing engine 230, determine the ipsilateral input signals 240

The mixing engine 230 computes the ipsilateral output signals 260 and the contralateral output signals 270 based on the ipsilateral input signals 240, the contralateral input signals 250, and the angle of arrival 220. The mixing engine 230 may compute the ipsilateral output signals 260 and the contralateral output signals 270 in any technically feasible fashion. In alternate embodiments, the mixing engine 230 may perform any number and type of compensation operations to generate the ipsilateral output signals 260 and the contralateral output signals 270.

For instance, in some embodiments, to compute the ipsilateral output signals 260 and the contralateral output signals 270, the mixing engine 230 implements the following equations (1) and (2):

$$I_{out}=A*I_{in}+B*(\mathrm{HRTF}_1(\mathrm{AOA})/\mathrm{HRTF}_C(\mathrm{AOA}))*C_{in} \quad (1)$$

$$C_{out}=A*C_{in}+B*(\mathrm{HRTF}_C(\mathrm{AOA})/\mathrm{HRTF}_I(\mathrm{AOA}))*I_{in} \quad (2)$$

In equation (1), $I_{out}$ denotes the ipsilateral output signals 260, and in equation (2) $C_{out}$ denotes the contralateral output signals 270. In equations (1) and (2), $I_{in}$ denotes the ipsilateral input signals 240, $C_{in}$ denotes the contralateral input signals 250, and AOA denotes the angle of arrival 220. Further, A is a first redistribution factor and B is a second redistribution factor. Together, the two redistribution factors influence the relative contributions of the ipsilateral input signals 240 and the contralateral input signals 250 to the ipsilateral output signals 260 and the contralateral output signals 270. $\mathrm{HRTF}_1$ is a head-related transfer function that that represents modifications to a sound as the sound travels from a source of the sound to the ipsilateral ear. By contrast, $\mathrm{HRTF}_C$ is a head-related transfer function that represents modifications to a sound as the sound travels from a source of the sound to the contralateral ear.

The mixing engine 230 may determine the redistribution factors and the head-related transfer functions in any technically feasible fashion. For example, the redistribution factors could be predetermined or configured via a user interface. In general, to preserve the overall gain of the audio system 100, the sum of the redistribution factors is approximately equal to one. In various embodiments, the head-related transfer functions may be computed based on impulse response measurements for the ears of "typical" user heads. Existing databases, such as the Center for Image Processing and Integrated Computing head related transfer function (CIPIC HRTF) database include such measurements. The mixing engine 230 may include pre-computed head-related transfer functions or may compute head-related transfer functions in any technically feasible fashion.

Finally, the mixing engine 230 performs mapping operations on the ipsilateral output signals 260 and the contralateral output signals 270 based on the ipsilateral side 222. More specifically, if the ipsilateral side 222 is equal to left, then the mixing engine 230 maps the ipsilateral output signals 260 to the left speaker signals 184 and the contralateral input signals 250 to the right speaker signals 194. By contrast, if the ipsilateral side 222 is equal to right, then the mixing engine 230 maps the ipsilateral output signals 260 to the right speaker signals 194 and the contralateral input signals 250 to the left speaker signals 184. The mixing engine 230 may implement the mapping operations in any technically feasible fashion. Subsequently, the gain redistribution subsystem 130 transmits the left speaker signals 184 to the left speaker ensemble 164 and the right speaker signals 194 to the right speaker ensemble 174.

In some embodiments, the angle engine 210 may determine that the sound source is directly in front of the head or directly behind the head. In such embodiments, the gain redistribution subsystem 130 may configure the mixing engine 230 to perform mixing operations on the left microphone signals 182 and the right microphone signals 192 to generate both the left speaker signals 184 and the right speaker signals 194 in any technically feasible fashion. For example, the gain redistribution subsystem 182 could set both the left speaker signals 192 and the right speaker signals 194 equal to "((0.5*the left microphone signals 182)+(0.5*the right microphone signals 192))."

For explanatory purposes only, at any given time, the sound received by the left microphone ensemble 162 and the right microphone ensemble 172 is generated by a single "sound source." In alternate embodiments, the sound received by the left microphone ensemble 162 and the right microphone ensemble 172 may be generated by any number and type of sources in any combination and at any locations relative to the head. In such embodiments, the angle engine 210 may determine whether multiple sound sources are present at a given time in any technically feasible fashion. For instance, in some embodiments, if the angle engine 210 computes multiple, apparently disjoint angles of arrivals during a relatively short amount of time, then the angle engine 210 determines that multiple sound sources are present. If the angle engine 210 determines that multiple sound sources are present, then the angle engine 210 may configure the mixing engine 230 to perform mixing operations based on values that are predetermined for the special case of multiple sound sources. For example, the angle engine 210 could set the default angle of arrival 220 to zero degrees (i.e., directly in front of the head). Further, to preserve stereo effects, the angle engine 210 could set the first redistribution factor A to 0.8 and the second redistribution factor B to 0.2.

In alternate embodiments, the gain redistribution subsystem 130 may be included in an audio system that is not currently head-worn. For example, the gain redistribution subsystem 130 could be included in an "bookshelf stereo system" or in headphones that are lying on a table. In such embodiments, the left microphone ensemble 162 and the left speaker ensemble 164 are associated with a left side of the audio system. The right microphone ensemble 172 and the right speaker ensemble 174 are associated with a right side of the audio system. The angle of arrival 220 between the sound source and the front of the head is replaced with an angle of arrival between the sound source and a "front operational face" of the audio system. Finally, the head-related transfer functions may be replaced with a transfer function that represents modifications to the sound as the sound travels from the source of the sound to the first side of the audio system, and a second transfer function that represents modifications to the sound as the sound travels from the source of the sound to the second side of the audio system.

As persons skilled in the art will recognize, as the distance between a microphone and a speaker increases, the amount of near field noise that is transmitted between the microphone and the speaker decreases. Notably, the distance between the contralateral microphone ensemble and the ipsilateral speaker ensemble is typically greater than the distance between the ipsilateral microphone ensemble and the ipsilateral speaker ensemble. Consequently, by generating the ipsilateral output signals 260 as a weighted summation across the ipsilateral input signals 240 and the contralateral input signals 250, the mixing engine 230 maintains a target volume while minimizing the near field noise that is delivered to the ipsilateral ear via the ipsilateral speaker ensemble. Further, because the mixing engine 230 weights the ipsilateral input signals 240 and the contralateral input signals 250 based on the angle of arrival 220 and the head-related transfer functions, the ipsilateral speaker ensemble delivers an accurate listening experience. More specifically, the ipsilateral output signals 260 cause the ipsilateral speaker ensemble to deliver high fidelity sound that accurately reproduces the audio information required for the user to determine the direction of the sound source.

Computing the Angle of Arrival

FIG. 3 is a more detailed illustration of the angle engine 210 of FIG. 2, according to various embodiments. As shown, the angle engine 210 includes, without limitation, a left-right engine 320, a front-back engine 350, and a resolution engine 370. For explanatory purposes only, the context of FIG. 3 is that the left microphone ensemble 162 includes, without limitation, a left-front microphone that generates the left microphone signal 182(1) and a left-back microphone that generates the left microphone signal 182(2). Similarly, the right microphone ensemble 172 includes, without limitation, a right-front microphone that generates the right microphone signal 192(1) and a right-back microphone that generates the right microphone signal 192(2).

As outlined previously in conjunction with FIG. 1, the angle engine 210 implements a three-step process to compute the angle of arrival 220. In a first step, the left-right engine 320 computes a left-right angle 340 and the ipsilateral side 222 based on the left microphone signal 182(1), the right microphone signal 192(1), and a left-right spacing 312. The left-right angle 340 is an angle between the sound source and the head that can vary, depending on the position of the sound source, from directly to the left of the head to directly to the right the head. The left-right spacing 312 is the spacing between the microphone that generates the left microphone signal 182(1) and the microphone that generates the right microphone signal 192(1). The left-right spacing 321 is typically approximately equal to a width of the head. In alternate embodiments, the left-right engine 320 may compute the left-right angle 340 based on any of the left microphone signals 182 and any of the right microphone signals 192 in any technically feasible fashion.

The left-right engine 320 implements source angle equations 330 to compute an "angle" based on two input signals "$IN_1$" and "$IN_2$," and a "spacing" between the input signals. In operation, the left-right engine 320 sets $IN_1$ equal to the left microphone signal 182(1), $IN_2$ equal to the right microphone signal 192(1), and spacing equal to the left-right spacing 312. The left-right engine 320 then computes the angle based on the source angle equations 330 and sets the left-right angle 340 equal to the computed angle.

More specifically, the source angle equations 330 include four separate equations (3), (4), (5), and (6) as follows:

$$\text{Phase Difference of Arrival (PDOA)}=\tan^{-1}(\text{Im}(IN_1*IN_2^*)/\text{Re}(IN_1*IN_2)) \quad (3)$$

$$\text{Time Difference of Arrival (TDOA)} = \text{PDOA}/(2*\pi*\text{freq}) \quad (4)$$

$$\text{Maximum Time (TMAX)} = \text{spacing/speed of sound} \quad (5)$$

$$\text{Angle} = \cos^{-1}(\text{TDOA/TMAX}) \quad (6)$$

First, the left-right engine 320 computes a phase difference of arrival between the left microphone signal 182(1) and the right microphone signal 192(1) based on equation (3). The left-right engine 320 then computes a time difference of arrival between the left microphone signal 182(1) and the right microphone signal 192(1) based on equation (4), the phase difference of arrival, and a frequency. The frequency is associated with at least one of the left microphone signal 182(1) and the right microphone signal 192(1), and the left-right engine 320 may compute the frequency in any technically feasible fashion. For example, the left-right engine 320 could compute an average frequency or could compute a center frequency of any bin in a filter bank. The left-right engine 320 then computes a maximum time based on equation (5) and the left-right spacing 312. Finally, the left-right engine 320 performs an inverse trigonometric operation to compute the left-right angle 340 based on the time difference of arrival and the maximum time.

Subsequently, the left-right engine 320 determines the ipsilateral side 222 and the ipsilateral input signals 240 based on the left-right angle 340. The left-right engine 320 may perform any number of comparison operations between angles associated with the head and the left-right angle 340 to determine whether the sound source is to the left of the head or to the right of the head. If the left-right engine 320 determines that the sound source is to the left of the head, then the left-right engine 320 sets the ipsilateral side 222 equal to left and the ipsilateral input signals 240 equal to the left microphone signals 182. If, however, the left-right engine 320 determines that the sound source is to the right of the head, then the left-right engine 320 sets the ipsilateral side 222 equal to right and the ipsilateral input signals 240 equal to the right microphone signals 192. The left-right engine 320 transmits the ipsilateral side 222 to the mixing engine 230, the ipsilateral input signals 240 to the front-back engine 350, and the left-right angle 340 to the resolution engine 370. In some embodiments, the left-right engine 320 may transmit the ipsilateral input signals 240 to the mixing engine 230.

In a second step of the process to compute the angle of arrival 220, the front-back engine 350 receives the ipsilateral input signals 240 and a front-back spacing 314 and then computes the front-back angle 360. The front-back angle 360 is an angle between the sound source and the head that can vary, depending on the position of the sound source, from directly in front of the head to directly behind the head. The ipsilateral input signal 240 includes, without limitation, a front ipsilateral input signal 240(1) and a back ipsilateral input signal 240(2). The front ipsilateral input signal 240(1) is generated by a "front" microphone in the ipsilateral microphone ensemble and the back ipsilateral input signal 240(2) is generated by a "back" microphone in the ipsilateral microphone. The front microphone is positioned in front of the back microphone relative to the head, and the front-back spacing 314 is the spacing between the front microphone and the back microphone.

As shown, the front-back engine 350 implements the source angle equations 330 described above in conjunction with the left-right engine 320. However, in contrast to the left-right engine 320, the front-back engine 350 sets $IN_1$ equal to the front ipsilateral input signal 240(1), $IN_2$ equal to the back ipsilateral input signal 240(2), and spacing equal to the front-back spacing 314. The front-back engine 350 then computes the angle based on the source angle equations 330 and sets the front-back angle 360 equal to the computed angle.

First, the front-back engine 350 computes a phase difference of arrival between the front ipsilateral input signal 240(1) and the back ipsilateral input signal 240(2) based on equation (3). The front-back engine 350 then computes a time difference of arrival between the front ipsilateral input signal 240(1) and the back ipsilateral input signal 240(2) based on equation (4), the phase difference of arrival, and a frequency. The frequency is associated with at least one of the front ipsilateral input signal 240(1) and the back ipsilateral input signal 240(2), and the front-back engine 350 may compute the frequency in any technically feasible fashion. The front-back engine 350 then computes a maximum time based on equation (5) and the front-back spacing 314. Finally, the front-back engine 350 performs an inverse trigonometric operation to compute the front-back angle 360 based on the time difference of arrival and the maximum time, and transmits the front-back angle 360 to the resolution engine 370.

In a third step of the process to compute the angle of arrival 220, the resolution engine 370 receives the left-right angle 340 and the front-back angle 360 and then computes the angle of arrival 220. The resolution engine 370 may compute the angle of arrival 220 in any technically feasible fashion. For instance, in some embodiments, the resolution engine 370 performs one or more comparison operations between the front-back angle 360 and angles associated with the head. If the resolution engine 370 determines that the front-back angle 360 indicates that the sound source is to the front of the head, then the resolution engine 370 sets the angle of arrival 220 equal to the left-right angle 340. If, however, the resolution engine 370 determines that the front-back angle 360 indicates that the sound source is to the back of the head, then the resolution engine 370 sets the angle of arrival 220 equal to the result of subtracting the left-right angle 340 from 180 degrees. In other embodiments, the resolution engine 370 may perform any number of triangulation operations based on the left-right angle 340 and the front-back angle 360 to compute the angle of arrival 220. Finally, the resolution engine 370 transmits the angle of arrival 220 to the mixing engine 230.

Figure 4:
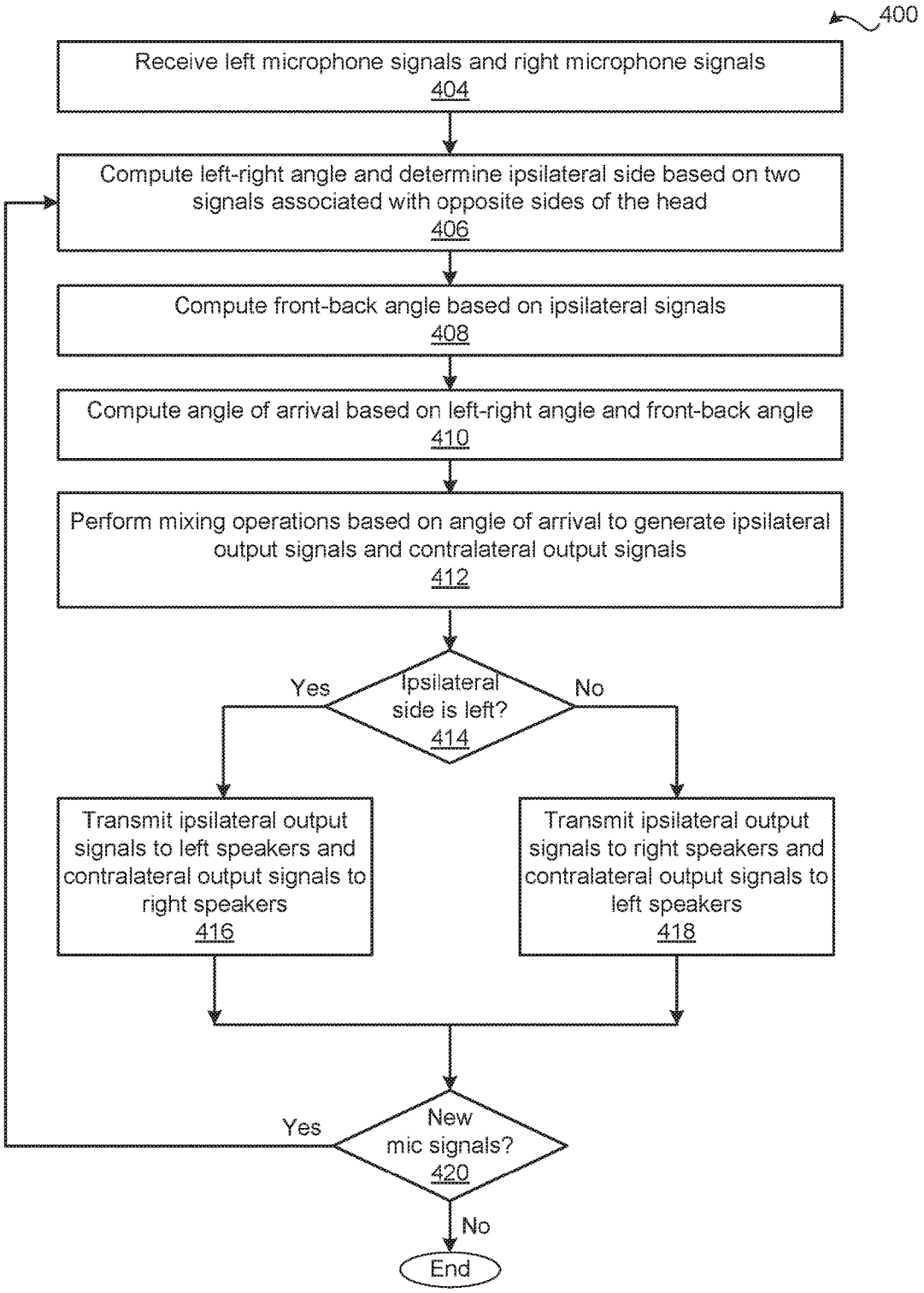
FIG. 4 is a flow diagram of method steps for delivering sound via a head-worn audio system, according to various embodiments.

FIG. 4 is a flow diagram of method steps for delivering sound via a head-worn audio system, according to various embodiments. Although the method steps are described in conjunction with the systems of FIGS. 1-3, persons skilled in the art will understand that any system configured to implement the method steps, in any order, falls within the scope of the contemplated embodiments.

As shown, a method 400 begins at step 404, where the gain redistribution subsystem 130 receives the left microphone signals 182 and the right microphone signals 192. As described previously herein, the left microphone signal 182(1) is generated by a microphone included in the left microphone ensemble 162 and the right microphone signals 192(1) is generated by a microphone included in the right microphone ensemble 172. At step 406, the left-right engine 230 computes the left-right angle 340 between the sound source and the head based on the left microphone signal 182(1) and the right microphone signal 192(1).

As part of step 406, the left-right engine 230 also determines whether the ipsilateral side 222 is left or right. Further, the left-right engine 230 sets the ipsilateral input signals 240 to either the left microphone signals 182 or the right microphone signals 192 based on the ipsilateral side 222. In alternate embodiments, the left-right engine 230 may compute the left-right angle 340 and determine the ipsilateral side 222 in any technically feasible fashion based on any two signals associated with opposite sides of the head. At step 408, the front-back engine 350 computes the front-back angle 360 based on the ipsilateral input signals 240(1) and 240(2), where the microphone that generates the ipsilateral input signal 240(1) is located in front of the microphone that generates the ipsilateral signal 240(2) relative to the head.

At step 410, the resolution engine 370 computes the angle of arrival 220 between the sound source and the head based on the left-right angle 340 and the front-back angle 360. The resolution engine 370 may compute the angle of arrival 220 in any technically feasible fashion. Further, in alternate embodiments, the angle engine 210 may replace steps 408-410 with a single step in which the angle engine 210 sets the angle of arrival 220 equal to the left-right angle 340, which reflects an assumption that the source is at an angle somewhere in the front of the head. In yet other embodiments, the angle engine 210 may replace steps 406-410 with a single step in which the angle engine 210 computes the angle of arrival 220 and the ipsilateral side 222 in any technically feasible fashion based on any number and combination of the left microphone signals 182 and the right microphone signals 192.

At step 412, the mixing engine 230 performs mixing operations on the ipsilateral input signals 240 and the contralateral input signals 250 based on the angle of arrival 220 to generate the ipsilateral output signals 260 and the contralateral output signals 270. As part of step 412, the mixing engine 230 sets the contralateral input signals 250 to either the left microphone signals 182 or the right microphone signals 192 based on the ipsilateral side 222.

At step 414, the gain redistribution subsystem 130 determines whether the ipsilateral side 222 is equal to left. If, at step 414, the gain redistribution subsystem 130 determines that the ipsilateral side 222 is equal to left, then the method 400 proceeds to step 416. At step 416, the gain redistribution subsystem 130 transmits the ipsilateral output signals 260 to left speaker ensemble 164 and the contralateral output signals 270 to the right speaker ensemble 174. The gain redistribution subsystem 130 may transmit the ipsilateral output signals 260 and the contralateral output signals 270 in any technically feasible fashion. The method 400 then proceeds directly to step 420.

If, however, at step 414, the gain redistribution subsystem 130 determines that the ipsilateral side 222 is not equal to left, then the method 400 proceeds directly to step 418. At step 418, the gain redistribution subsystem 130 transmits the ipsilateral output signals 260 to right speaker ensemble 174 and the contralateral output signals 270 to the left speaker ensemble 164. The gain redistribution subsystem 130 may transmit the ipsilateral output signals 260 and the contralateral output signals 270 in any technically feasible fashion. The method 300 then proceeds directly to step 420.

At step 420, the gain redistribution subsystem 130 determines whether the gain redistribution subsystem 130 has received any new left microphone signals 182 or right microphone signals 192. If, at step 420, the gain redistribution subsystem 130 determines that the gain redistribution subsystem 130 has received new left microphone signals 182 or right microphone signals 192, then the method 400 returns to step 406, where the gain redistribution subsystem 130 recomputes the left-right angle of arrival 220 and the ipsilateral side 222 based on the new left microphone signals 182 and the new right microphone signals 192. The gain redistribution subsystem 130 continues to cycle through steps 406-420, recomputing the left speaker signals 184 and the right speaker signals 194, until the gain redistribution subsystem 130 determines that the gain redistribution subsystem 130 has not received any new left microphone signals 182 or any new right microphone signals 192.

If, however, at step 420, the gain redistribution subsystem 130 determines that the gain redistribution subsystem 130 has not received any new left microphone signals 182 or any new right microphone signals 192, then the method 400 terminates. The gain redistribution subsystem 130 may cease receiving the left microphone signals 182 and the right microphone signals 192 for any number of reasons. For example, the left microphone ensemble 162 and the right microphone ensemble 172 could be turned off. In another example, the amplitudes of the left microphone signals 182 and the right microphone signals 192 may be below predefined thresholds. In such embodiments, the gain redistribution subsystem 130 may consider self-noise associated with the left microphone ensemble 172 and self-noise associated with the right-microphone ensemble 172 as multiple sound sources. The gain redistribution subsystem 130 may process the left microphone signals 182 and the right microphone signals 192 associated with multiple sound sources in any technically feasible fashion, such as the process outlined in conjunction with FIG. 2.

In sum, the disclosed techniques may be used to optimize the listening experience of a user via a head-worn audio system. The audio system includes a left microphone ensemble, a left speaker ensemble, a right microphone ensemble, a right speaker ensemble, and a gain redistribution subsystem. During operation, the left microphone ensemble and the left speaker ensemble are located in close proximity to a left ear of the head of the user and the right microphone ensemble and the right speaker ensemble are located in close proximity to a right ear of the head. The left microphone ensemble and the right microphone ensemble transmit, respectively left microphone signals and right microphone signals to the gain redistribution subsystem. The gain redistribution system drives the left speaker ensemble and the right speaker ensemble via, respectively, left speaker signals and right speaker signals. The gain redistribution subsystem includes an angle engine and a mixing engine.

Upon receiving the left microphone signals and the right microphone signals, the angle engine computes an angle of arrival. The angle of arrival is an angle between a sound source and the head of the user. The angle engine also determines whether the sound source is located to the left side of the head or the right side of the head. If the sound source is located to the left side of the head, then the mixing engine combines the left microphone signals and the right microphone signals based on the angle of arrival to generate the left speaker signals that mitigate near field noise associated with the left microphone signals. The mixing engine also combines the left microphone signals and the right microphone signals based on the angle of arrival to generate the right speaker signals. By contrast, if the sound source is located to the right side of the head, then the mixing engine combines the left microphone signals and the right microphone signals based on the angle of arrival to generate the right speaker signals that mitigate near field noise associated with the right microphone signals. The mixing engine also combines the left microphone signals and the right microphone signals based on the angle of arrival to generate the left speaker signals.

At least one advantage of the disclosed approach is that by restructuring the gain between microphones and speakers, the gain redistribution subsystem effectively reduces near field noise transmitted to the user during operation in a more comprehensive fashion relative to conventional designs. In particular, unlike conventional approaches to reducing near field noise, the audio system does not necessarily include fitted ear inserts. Further, the gain redistribution subsystem reduces near field noise associated with sound that travels inside the ear as well as sound that leaks outside the ear.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable gate arrays.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A method for delivering sound via a head-worn audio system, the method comprising:

determining that a source of a sound is present on a first side of a head based on a first input signal generated by a first microphone that is located on the first side of the head and a second input signal generated by a second microphone that is located on a second side of the head;

performing one or more mixing operations on the first input signal and the second input signal to generate a first output signal that mitigates near field noise included in the first input signal; and transmitting the first output signal to a first speaker that is arranged to deliver sound to a first ear that is located on the first side of the head.

2. The method of claim 1, further comprising:

performing one or more mixing operations on the first input signal and the second input signal to generate a second output signal; and transmitting the second output signal to a second speaker that is arranged to deliver sound to a second ear that is located on the second side of the head.

3. The method of claim 1, wherein performing the one or more mixing operations comprises:

performing a weighting operation on the first input signal based on a first redistribution factor to generate a first weighted input signal;

performing a weighting operation on the second input signal based on at least one of an angle of arrival, one or more head-related transfer functions, and a second redistribution factor to generate a second weighted input signal; and performing a summation operation across the first weighted input signal and the second weighted input signal.

4. The method of claim 3, wherein the one or more head-related transfer functions include a first transfer function that represents modifications to the sound as the sound travels from the source of the sound to the first ear, and a second transfer function that represents modifications to the sound as the sound travels from the source of the sound to a second ear that is located on the second side of the head.

5. The method of claim 3, further comprising, prior to performing the one or more mixing operations, computing the one or more head-related transfer functions based on a plurality of head-related impulse responses.

6. The method of claim 3, wherein the first redistribution factor is greater than the second redistribution factor, and the sum of the first redistribution factor and the second redistribution factor is approximately equal to one.

7. The method of claim 3, further comprising, prior to performing the weighting operation on the first input signal:

determining that at least a second source of a second sound is present based on the first input signal and the second input signal;

setting the first redistribution factor equal to a first predetermined value and the second redistribution factor equal to a second predetermined value that exceeds the second predetermined value; and setting the angle of arrival to indicate a direction directly in front of the head.

8. The method of claim 1, wherein determining that the source of the sound is present on the first side of the head comprises computing an angle of arrival between the source of the sound and the head.

9. The method of claim 8, wherein computing the angle of arrival comprises computing a left-right angle of arrival between the source of the sound and the head, and setting the angle of arrival equal to the left-right angle of arrival.

10. The method of claim 8, wherein computing the angle of arrival comprises:

computing a left-right angle of arrival between the source of the sound and the head;

computing a front-back angle of arrival between the source of the sound and the head based on a third input signal generated by a third microphone that is located on the first side of the head; and determining the angle of arrival based on the left-right angle of arrival and the front-back angle or arrival.

11. The method of claim 8, wherein computing the angle of arrival comprises:

computing a time difference between the first input signal and the second input signal;

computing a maximum time based on a spacing between the first microphone and the second microphone; and performing at least one inverse trigonometric operation on a ratio between the time difference and the maximum time.

12. The method of claim 11, wherein computing the time difference comprises:

computing a phase difference between the first input signal and the second input signal; and performing one or more scaling operations on the phase difference.

13. A head-worn audio system configured to deliver sound, the head-worn audio system comprising:

a first microphone ensemble that is associated with a first side of the head-worn audio system;

a second microphone ensemble that is associated with a second side of the head-worn audio system;

a first speaker ensemble that is associated with the first side of the head-worn audio system;

a memory storing a gain redistribution application; and a processor that is coupled to the memory, wherein, when executed by the processor, the gain redistribution application configures the processor to:

determine that a source of a sound is present on the first side of the head-worn audio system based on a first input signal generated by the first microphone ensemble and a second input signal generated by the second microphone ensemble;

perform one or more mixing operations on the first input signal and the second input signal to generate a first output signal, wherein the one or more mixing operations redistribute a gain associated with the first microphone ensemble to mitigate near field noise included in the first input signal; and transmit the first input signal to the first speaker ensemble.

14. The head-worn audio system of claim 13, further comprising a second speaker ensemble that is associated with the second side of the head-worn audio system and wherein the gain redistribution application further configures the processor to:

perform one or more mixing operations on the first input signal and the second input signal to generate a second output signal; and transmit the second output signal to the second speaker ensemble.

15. The head-worn audio system of claim 13, wherein the gain redistribution application configures the processor to perform the one or more mixing operations by:

performing a weighting operation on the first input signal based on a first redistribution factor to generate a first weighted input signal;

performing a weighting operation on the second input signal based on at least one of an angle of arrival, one or more transfer functions, and a second redistribution factor to generate a second weighted input signal; and performing a summation operation across the first weighted input signal and the second weighted input signal.

16. The head-worn audio system of claim 15, wherein the one or more transfer functions include a first transfer function that represents modifications to the sound as the sound travels from the source of the sound to the first side of the head-worn audio system, and a second transfer function that represents modifications to the sound as the sound travels from the source of the sound to the second side of the head-worn audio system.

17. The head-worn audio system of claim 15, wherein the first redistribution factor is greater than the second redistribution factor, and the sum of the first redistribution factor and the second redistribution factor is approximately equal to one.

18. The head-worn audio system of claim 13, wherein the gain redistribution application configures the processor to determine that the source of the sound is present on the first side of the head-worn audio system by computing an angle of arrival between the source of the sound and a front operational face of the head-worn audio system.

19. A non-transitory computer-readable storage medium including instructions that, when executed by a processor, configure the processor within a head-worn audio system to perform the steps of:

determining that a source of a sound is present on a first side of the head-worn audio system based on a first input signal generated by a first microphone that is associated with the first side of the head-worn audio system and a second input signal generated by a second microphone that is associated with a second side of the head-worn audio system;

performing one or more mixing operations on the first input signal and the second input signal based on an angle of arrival between the source of the signal and a front operational face of the head-worn audio system to generate a first output signal that redistributes a gain associated with the first microphone; and transmitting the first output signal to a first speaker that is associated with the first side of the head-worn audio system.

20. The computer-readable storage medium of claim 19, further comprising:

performing one or more mixing operations on the first input signal and the second input signal based on the angle of arrival to generate a second output signal; and transmitting the second output signal to a second speaker that is associated with the second side of the head-worn audio system.

21. The computer-readable storage medium of claim 19, wherein performing the one or more mixing operations comprises:

performing a weighting operation on the first input signal based on a first redistribution factor to generate a first weighted input signal;

performing a weighting operation on the second input signal based on at least one of the angle of arrival, one or more transfer functions, and a second redistribution factor to generate a second weighted input signal; and performing a summation operation across the first weighted input signal and the second weighted input signal.

* * * * *